US007178839B2

(12) United States Patent
Tsai

(10) Patent No.: US 7,178,839 B2
(45) Date of Patent: Feb. 20, 2007

(54) LATCH ASSEMBLY FOR SLIDING DOORS

(75) Inventor: Miao-Hsueh Tsai, Taichung (TW)

(73) Assignee: Imperial USA, Ltd., Charlotte, NC (US)

( * ) Notice: Subject to any disclaimer, the term of this patent is extended or adjusted under 35 U.S.C. 154(b) by 0 days.

(21) Appl. No.: 10/457,577

(22) Filed: Jun. 9, 2003

(65) Prior Publication Data

US 2004/0245784 A1 Dec. 9, 2004

(51) Int. Cl.
*E05B 25/02* (2006.01)

(52) U.S. Cl. ..... 292/51; 292/25; 292/95; 292/112; 292/280; 292/DIG. 46

(58) Field of Classification Search ..... 292/24–25, 292/51, 95, 110, 112, 280, DIG. 46, 26, 30, 292/44, 45, 48, 279
See application file for complete search history.

(56) References Cited

U.S. PATENT DOCUMENTS 703,976 A * 7/1902 Southard ..... 292/51
959,494 A * 5/1910 Fisher ..... 292/51
3,744,829 A * 7/1973 Germer ..... 292/22
4,958,508 A * 9/1990 Lin ..... 292/51
5,595,409 A * 1/1997 Fier et al. ..... 292/112
5,642,909 A * 7/1997 Swan et al. ..... 292/39
5,951,068 A * 9/1999 Strong et al. ..... 292/39
6,327,879 B1 * 12/2001 Malsom ..... 292/51
6,682,109 B2 * 1/2004 Horne et al. ..... 292/22
6,776,441 B2 * 8/2004 Liu ..... 292/26
2006/0119108 A1 * 6/2006 Heid et al. ..... 292/97

* cited by examiner

*Primary Examiner*—Gary Estremsky
*Assistant Examiner*—Christopher Boswell
(74) *Attorney, Agent, or Firm*—Alston & Bird LLP

(57) ABSTRACT

A latch assembly connected to a lock face of a sliding door includes two hooks which are connected to two activation plates respectively. Two rotation gears each have teeth engaged with the activation plates which are moved to pivot the two hooks when the two gears are rotated. A safety member is biased by a spring and includes a contact pin which movably extends through the lock face on the sliding door so that the safety member is pushed when the contact pin is pushed by a fixed door when the sliding door is in close position. The safety member further has an engaging pin which is removably engaged with the recess of the activation plate so that when the sliding door is in open position, the activation plate cannot be moved and the hooks are remained in the sliding door.

8 Claims, 8 Drawing Sheets

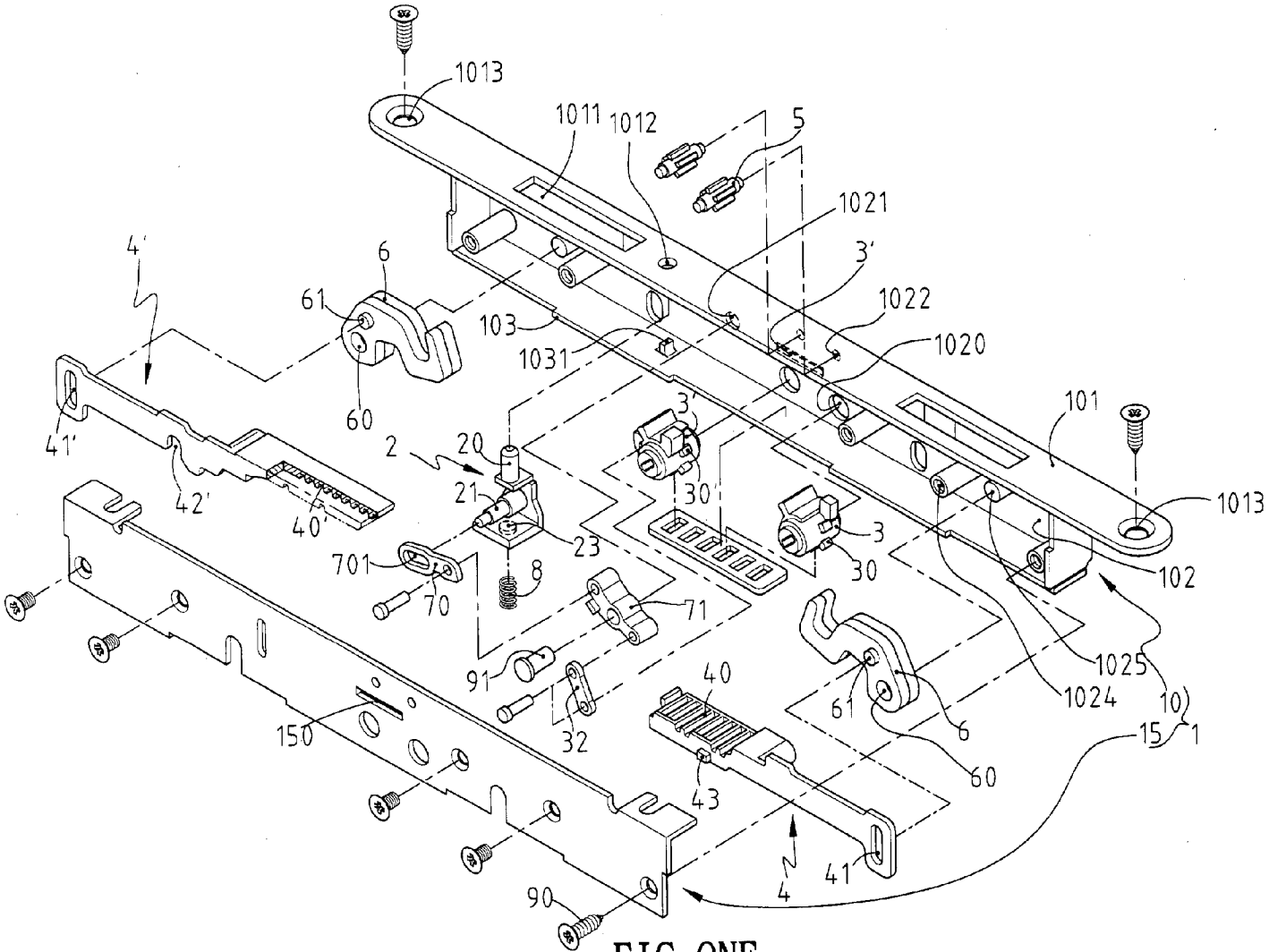
FIG. ONE

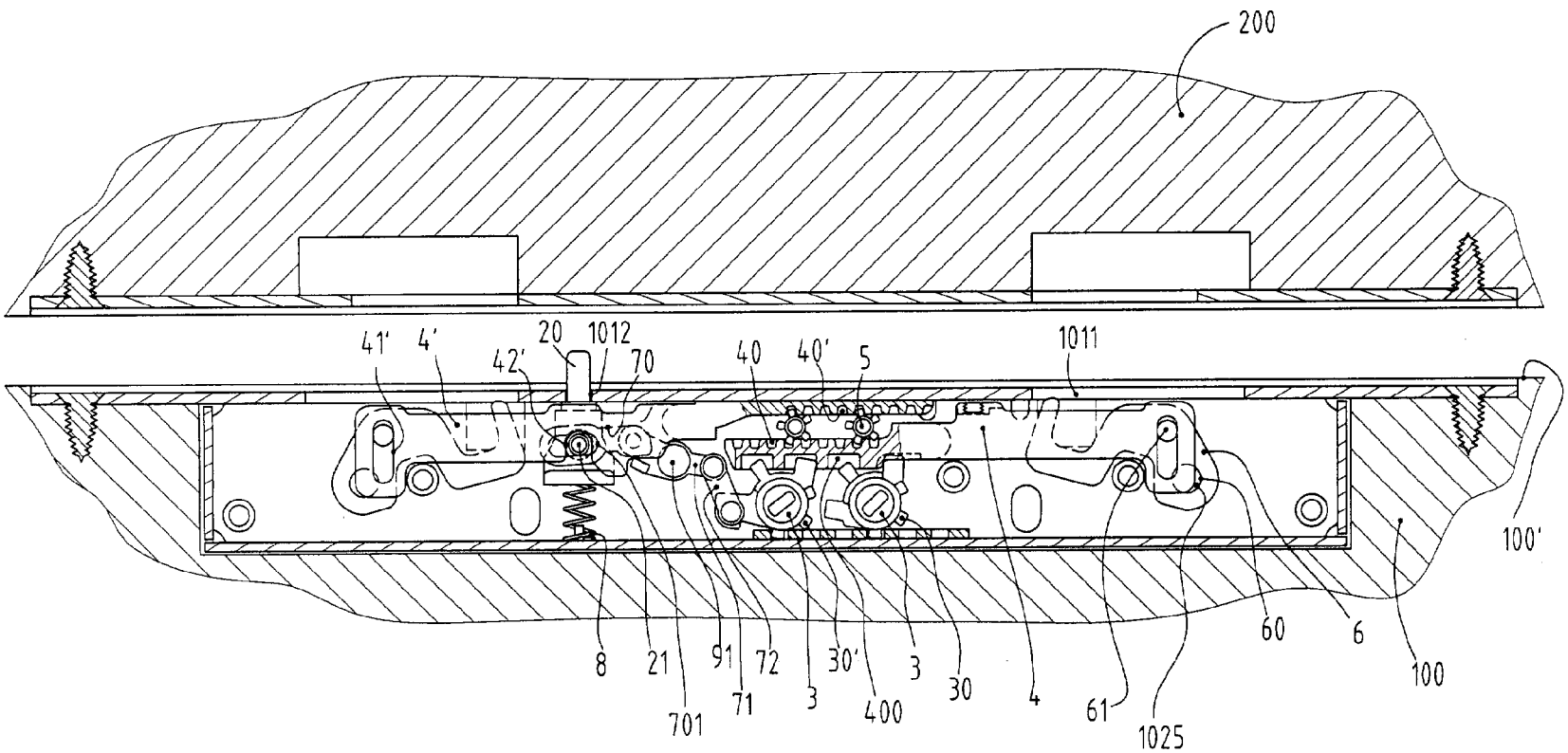
FIG. TWO

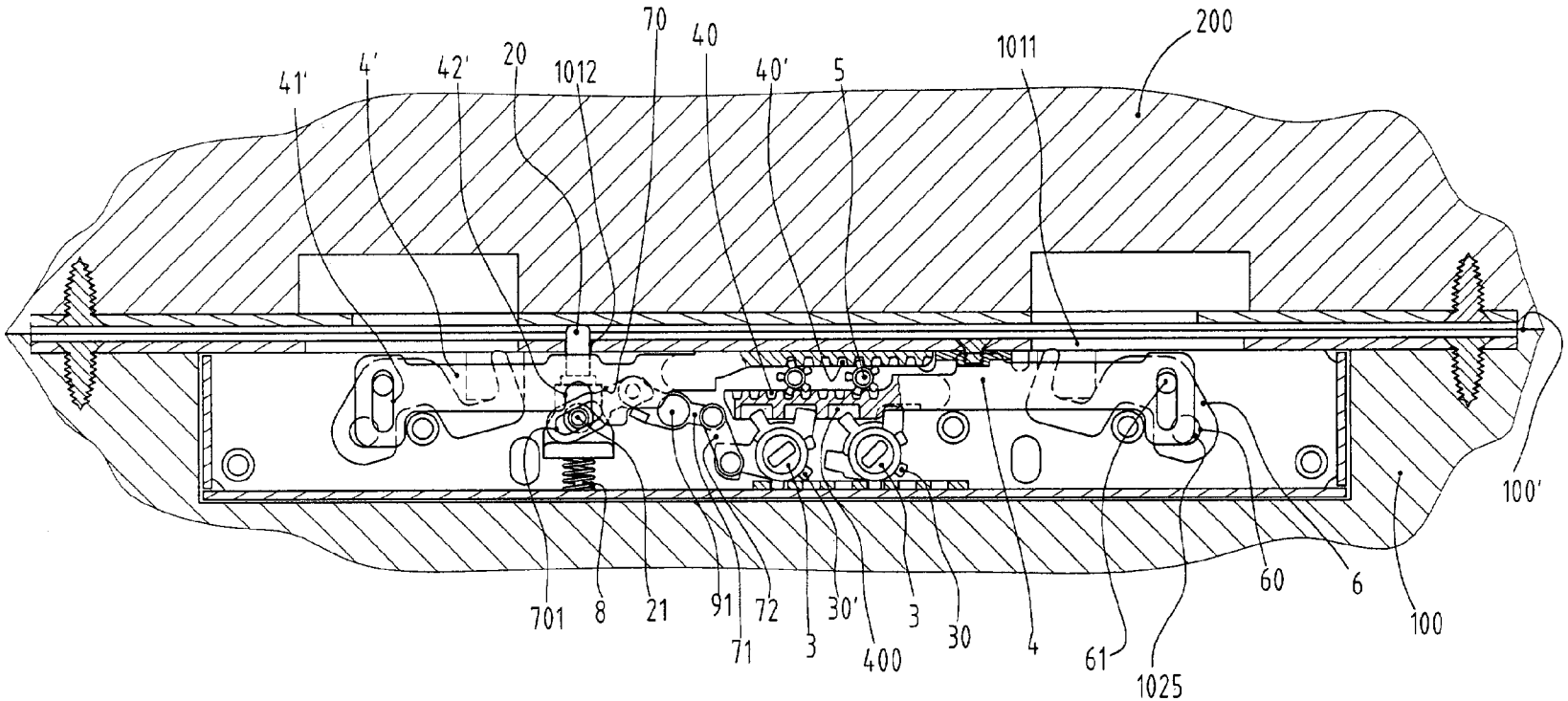
FIG. THREE

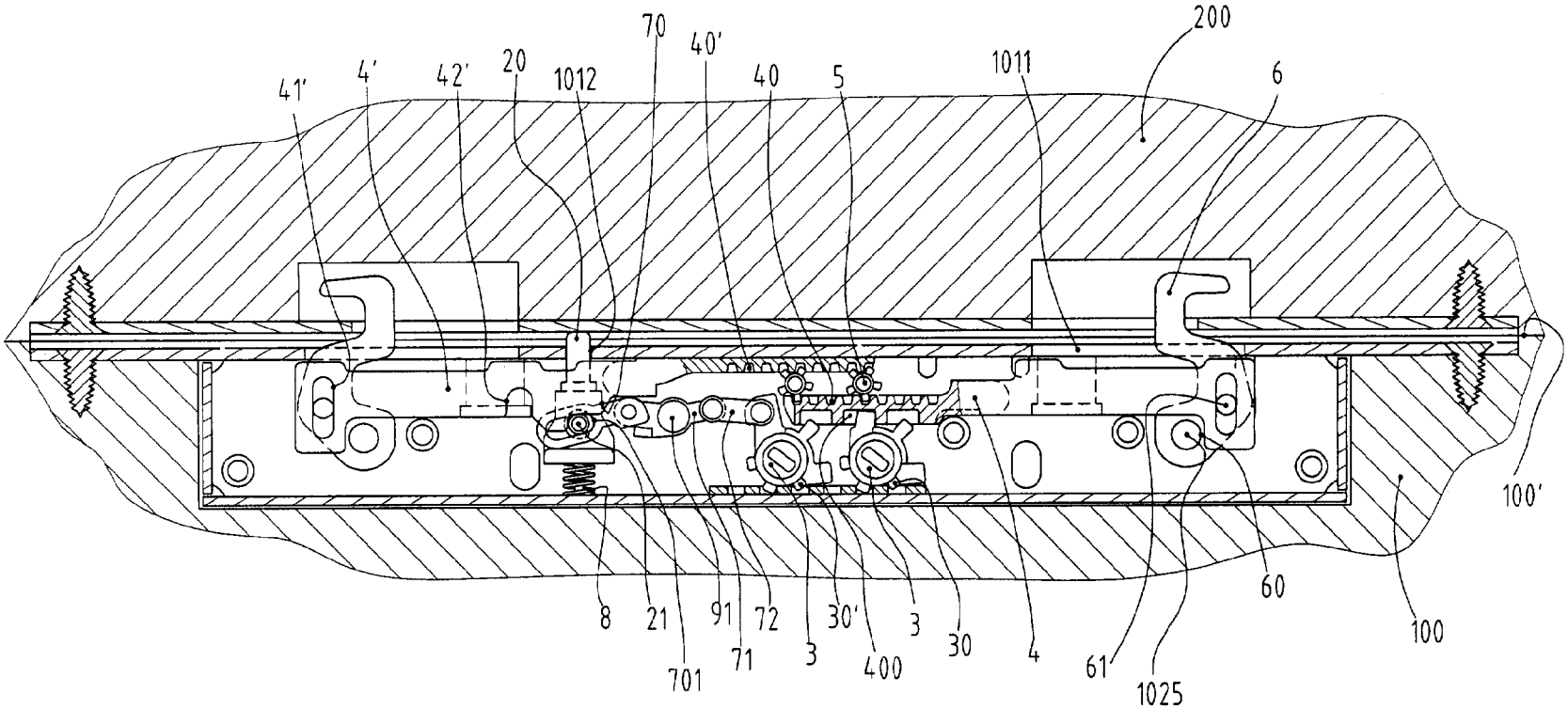
FIG. FOUR

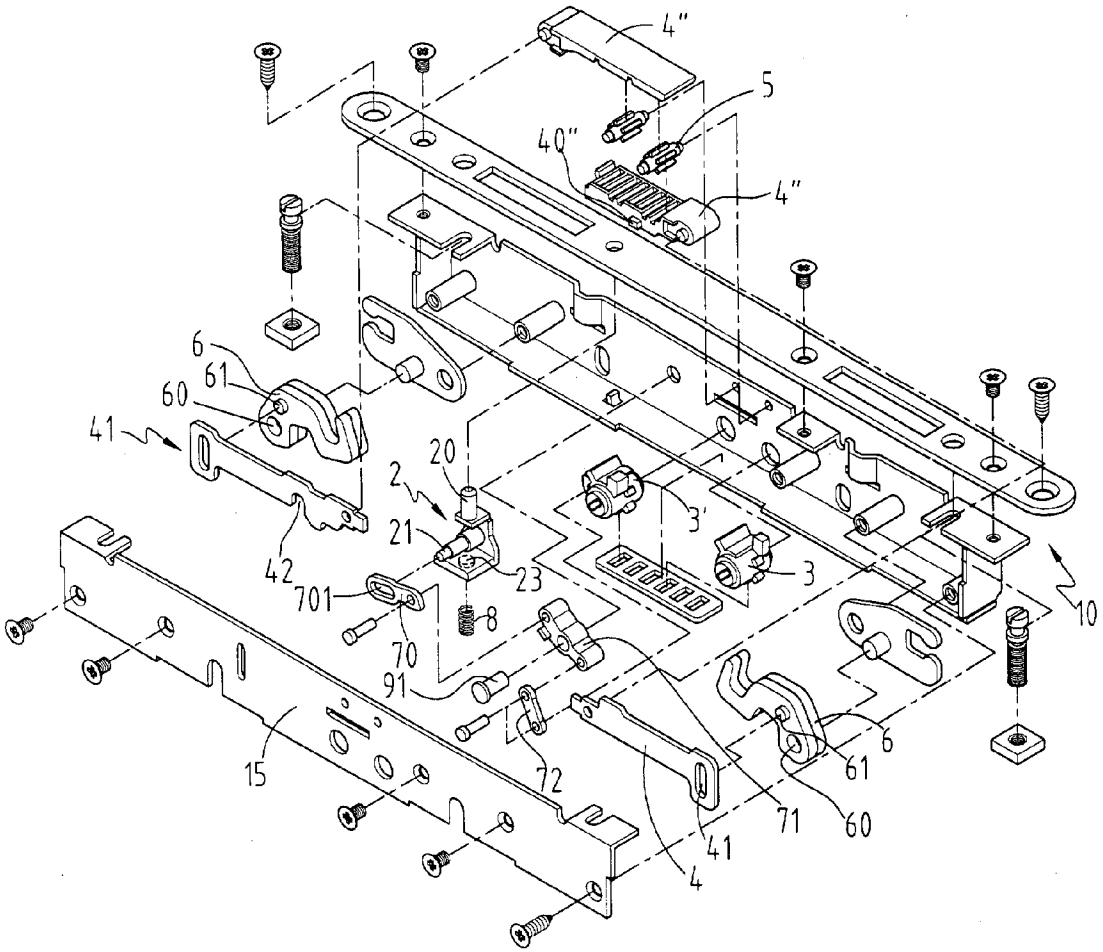
FIG. FIVE

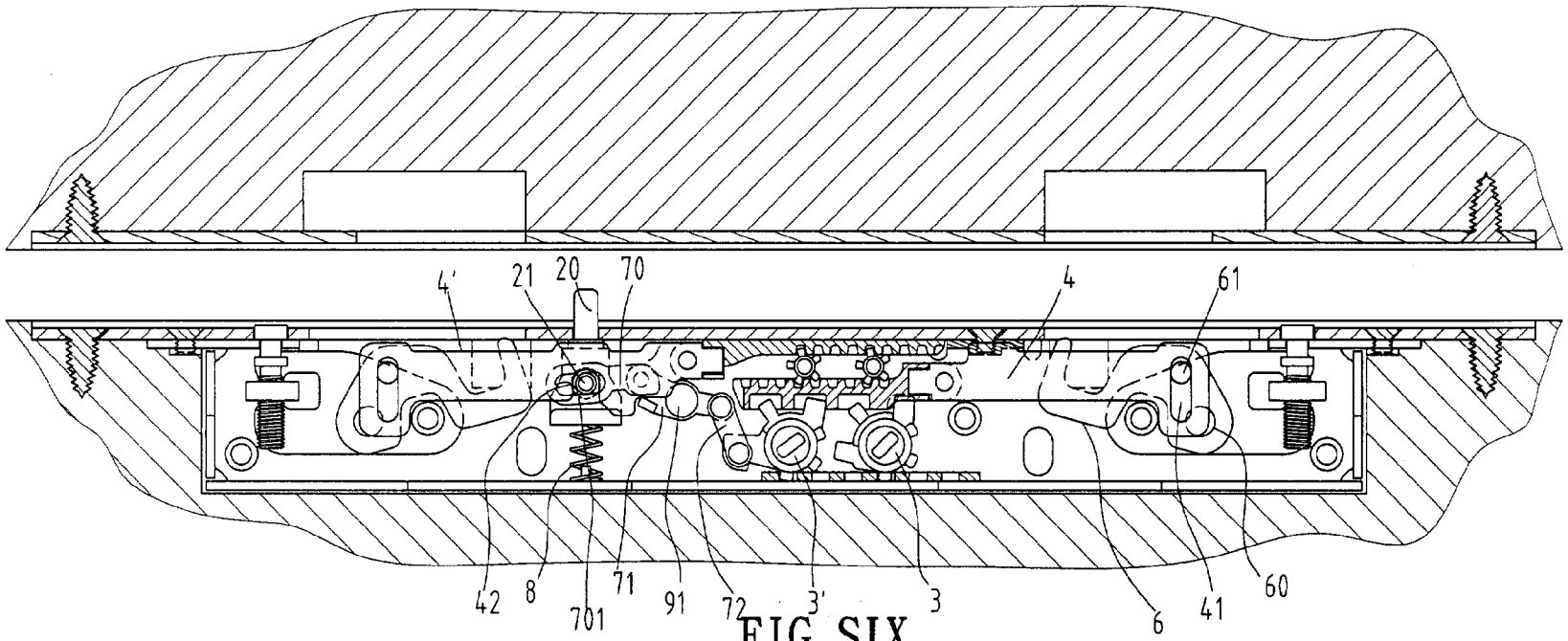
FIG. SIX

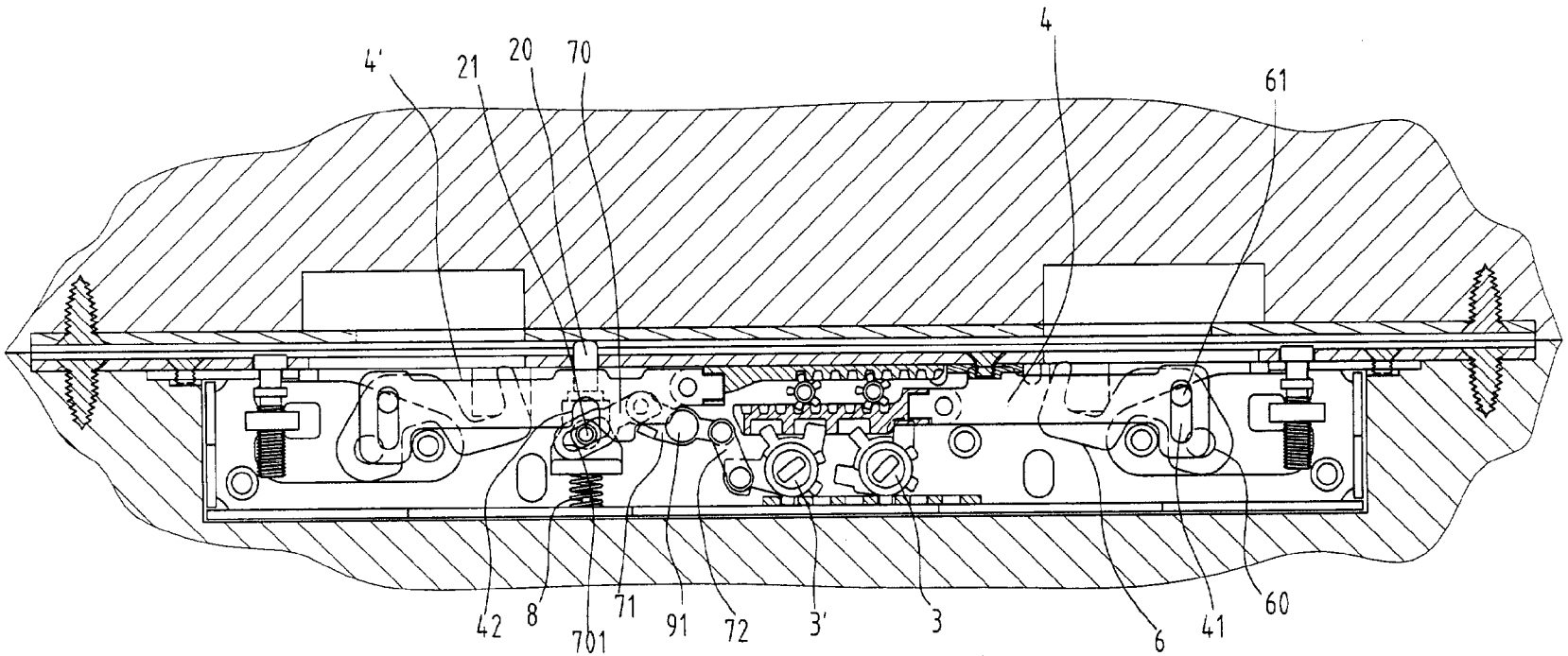
FIG. SEVEN

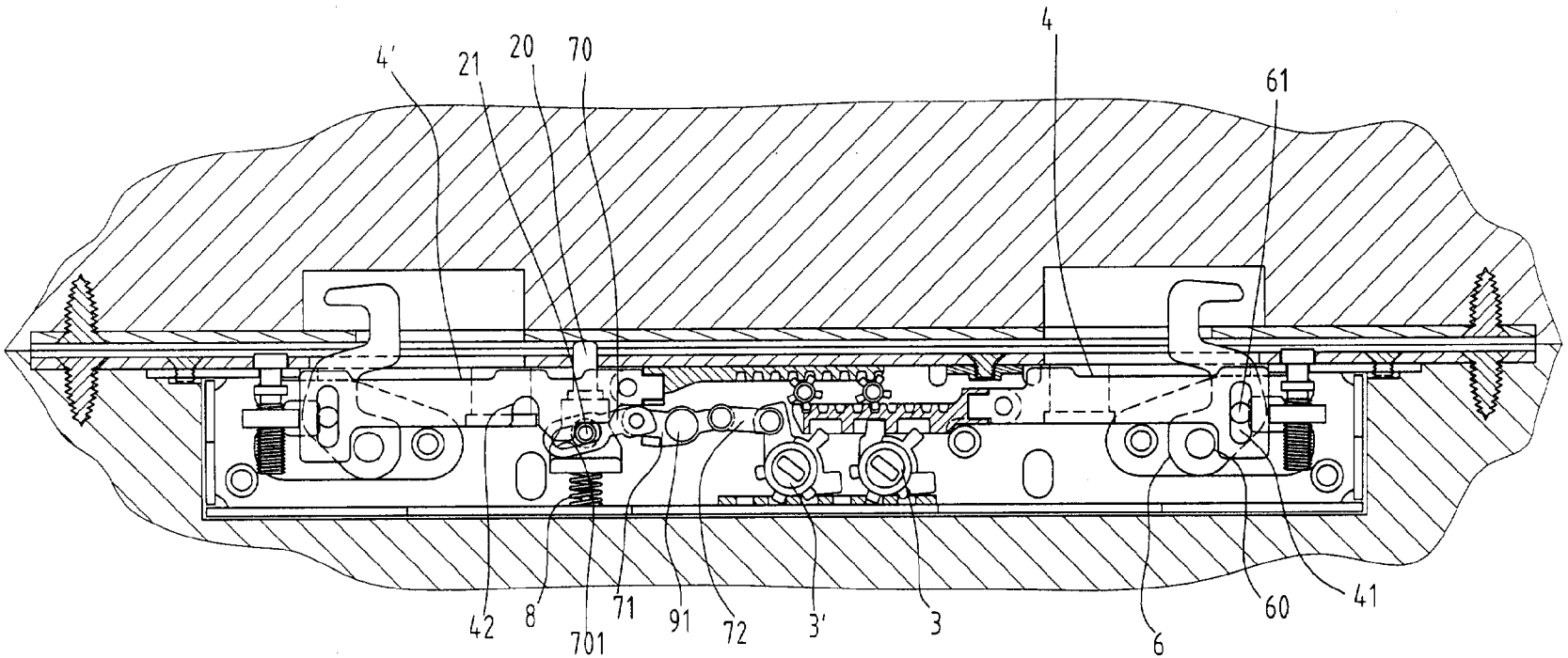
FIG. EIGHT

LATCH ASSEMBLY FOR SLIDING DOORS

FIELD OF THE INVENTION

The present invention relates to a sliding door latch assembly which includes two hooks and a safety device which controls the two hooks to be received in the sliding door if the sliding door is in open position.

BACKGROUND OF THE INVENTION

A conventional patio sliding door generally includes a latch assembly connected to the lock face of the stile and includes a hook which is operated by a control member so that the hook can be pivoted to hook on part on a fixed door. The single-hook structure of the conventional latch assembly is easily to be opened by force and cannot exclude forced entry. Besides, the hook can be extended out from the slot defined in the lock face of the sliding door without any limitation so that the hook can be in lock position while the sliding door is in open position. This is to say, if the sliding door is slid to close while the hook is extended, the hook and/or the whole latch assembly can be damaged.

The present invention intends to provide a sliding door latch assembly that has a safety member which is movably located on the lock face of the sliding door and only if the safety member is pushed when the door is in close position, the hooks can be pivoted.

SUMMARY OF THE INVENTION

In accordance with one aspect of the present invention, there is provided a latch assembly connected to a lock face of a sliding door and the latch assembly comprises a trim plate with two slots and a first hole. A safety member is movably received in the box connected to the trim plate and a spring is connected between the safety member and a rear plate of the box. The safety member includes a contact pin extending through the first hole and an engaging pin connected to a link assembly. Two hooks are pivotably connected to a side plate of the box and located corresponding to the two slots. Two activation plates are movably received in the box and each activation plate has an end pivotably connected to respective one of the hooks. One of the activation plates has a recess defined in an edge thereof and the engaging pin of the safety member is removably engaged with the recess. A driving device is located between the two activation plates so as to drive the two activation plates simultaneously. Two rotation gears are rotatably connected to the side plate of the box and each of which includes teeth which are engaged with notches defined in one of the activation plates. The other end of the link assembly is connected to one of the two rotation gears.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is an exploded view to show the latch assembly of the present invention;

FIG. 2 is a side view to show the latch assembly of the present invention when the sliding door is in open position;

FIG. 3 is a side view to show the latch assembly of the present invention when the sliding door is in close position;

FIG. 4 shows the two hooks are able to be pivoted when the sliding door is in close position;

FIG. 5 is an exploded view to show another embodiment of the latch assembly of the present invention;

FIG. 6 is a side view to show the latch assembly of the present invention in FIG. 5 when the sliding door is in open position;

FIG. 7 is a side view to show the latch assembly of the present invention in FIG. 5 when the sliding door is in close position, and FIG. 8 shows the two hooks in FIG. 5 are able to be pivoted when the sliding door is in close position.

DETAILED DESCRIPTION OF THE PREFERRED EMBODIMENT

Referring to FIGS. 1 and 2, the latch assembly 1 connected to a lock face 100' of a sliding door 100 of the present invention comprises a trim plate 101 having two slots 1011 and a first hole 1012 respectively defined therethrough and a box 10 connected to the trim plate 101. The box 10 is composed by two side plates 102, 15 and a rear plate 103. The side part 15 is fixed to threaded tubes 1024 on the inside of the side plate 102 by screws 90. The trim plate 101 is fixed to the lock face 101 by two screws extending through two holes 1013 in two ends of the trim plate 101 and fixed to the lock face. A safety member 2 is movably received in the box 10 and a spring 8 is connected between a boss 23 on an underside of the safety member 2 and a protrusion 1031 on the rear plate 103 of the box 10. The safety member 2 includes a contact pin 20 extending through the first hole 1012 and an engaging pin 21 is connected to a link assembly 7 in the box 10. Two hooks 6 each have a pivot hole 60 and two rods 1025 on the side plate 102 extend through the two pivot holes 60 so that the two hooks 6 are pivotably connected to the side plate 102 of the box 10 and located corresponding to the two slots 1011.

Two activation plates 4 and 4' are movably received in the box 10 and each activation plate 4/4' has a slot 41/41' at one end thereof and each hook 6 has a boss 61 on a side thereof so that the boss 61 are movably engaged with the slot 41/41' of the two activation plates 4, 4'. The activation plates 4' has a recess 42' defined in an edge thereof and the engaging pin 21 of the safety member 2 extends through a slot 701 defined through the first link 70 of the link assembly 7 and is removably engaged with the recess 42' so as to prevent the activation plate 4' from moving. The link assembly 7 includes a pivotable link 71 pivotably connected to a hole 1021 in the side plate 102 of the box 10 by a pin 91, and the first link 70 and a second link 72 are pivotably connected to two ends of the pivotable link 71. The other end of each activation plate 4/4' has a toothed surface 40/40', the two toothed surfaces 40, 40' being located to face each other. A driving device 5 is located between the two activation plates 4, 4' and includes two pinions 5 which are connected to two holes 1022 in the side plate 102 and engaged with the two toothed surfaces 40, 40'. Each of the two activation plates 4, 4' has a tongue 43 on a side thereof and the two tongues 43 are movably engaged with two respective slots 1023, 150 defined in the two side plates 102, 15.

Two rotation gears 3, 3' are rotatably connected to two holes 1020 in the side plate 102 of the box 10 and each of which includes teeth 30/30' which are engaged with notches 400 defined in the activation plate 4 on the opposite side of the toothed surface 40. The second link 72 of the link assembly 7 is connected to one of the two rotation gears 3, 3'.

When the sliding door 100 is in its open position, the two engaging pin 21 is engaged with the recess 42' of the activation plate 4' so that the two rotation gears 3, 3' cannot be rotated and the two hooks 6 are received in the box 10 as shown in FIG. 2.

When the sliding door 100 is slid to its close position and the lock face 100' contacts the fixed door 200, the contact pin 20 is pushed into the box 10 and the engaging pin 21 is removed from the recess 42' of the activation plate 4' as shown in FIG. 3. The two rotation gears 3, 3' are then able to be rotated to drive the activation plate 4 to move and the activation plate 4' is moved simultaneously by the two pinions 5. The two hooks 6 are then pivoted by the movement of the two activation plates 4, 4' to extend through the slots 1011 to hook on the fixed door 200 as shown in FIG. 4. In other words, the hooks 6 can be pivoted out from the slots 1011 only when the engaging pin 20 is pushed and this effectively prevents the gears 3, 3' are unintentionally rotated.

FIGS. 5 to 8 show another embodiment of the latch assembly wherein the difference between the two embodiments is that the activation plates 4, 4' are composed of two parts. The part 4" that has the toothed surface 40" can be disengagably connected to the other part that has the slot 41.

While we have shown and described the embodiment in accordance with the present invention, it should be clear to those skilled in the art that further embodiments may be made without departing from the scope of the present invention.

What is claimed is:

1. A latch assembly connected to a lock face of a sliding door, comprising:

a trim plate having two slots and a first hole respectively defined therethrough and a box connected to the trim plate, a safety member movably received in the box and a spring connected between the safety member and a rear plate of the box, the safety member including a contact pin extending through the first hole and an engaging pin connected to a link assembly in the box, two hooks pivotably connected to a side plate of the box and located corresponding to the two slots;

two activation plates movably received in the box and each activation plate having an end thereof pivotably connected to respective one of the hooks, one of the activation plates having a recess defined in an edge thereof and the engaging pin of the safety member removably engaged with the recess, a driving device located between the two activation plates so as to drive the two activation plates simultaneously, and two rotation gears rotatably connected to the side plate of the box and each of which includes teeth which are engaged with notches defined in the other activation plate, the other end of the link assembly connected to one of the two rotation gears.

2. The latch assembly as claimed in claim 1, wherein each activation plate includes a slot at one end thereof, the other end of each activation plate has a toothed surface, the two toothed surfaces being located to face each other, the driving device including two pinions which are engaged with the two toothed surfaces.

3. The latch assembly as claimed in claim 1, wherein the link assembly includes a pivotable link pivotably connected to the side plate of the box and a first link and a second link are pivotably connected to two ends of the pivotable link, the first link including a slot through which the engaging pin extends and the second link pivotably connected to one of the two rotation gears.

4. A latch assembly configured to be connected to a lock face of a sliding door, the latch assembly comprising:

a trim plate configured to be connected to the lock face of the door, the trim plate defining two slots and a first hole therethrough;

a box connected to the trim plate, the box having at least one side plate extending from the trim plate and a rear plate connected to the side plate opposite the trim plate;

a safety member movably received in the box and a spring connected between the safety member and the rear plate of the box, the safety member including a contact pin and an engaging pin, the contact pin extending through the first hole of the trim plate;

two hooks pivotably connected to the side plate of the box, each hook being located proximate one of the two slots in the trim plate such that the hooks are configured to be extended through the slots to engage a fixed door adjacent the lock face of the door;

first and second activation plates movably disposed in the box, each activation plate having a first end pivotably connected to a respective one of the hooks, and the first activation plate defining a recess in an edge thereof, the engaging pin of the safety member being configured to be removably received in the recess when the door is in an open position and the contact pin extends from the box through the first hole of the trim plate, and the engaging pin of the safety member being configured to be removed from the recess when the door is in a closed position with the lock face against the fixed door such that the contact pin is pushed into the box;

a driving device located between the activation plates and configured to drive the activation plates simultaneously;

two rotation gears rotatably connected to the side plate, each rotation gear including teeth engaged with notches defined by one of the activation plates; and a link assembly in the box, the link assembly extending between the engaging pin and one of the two rotation gears such that the rotation gears are prevented from rotating when the engaging pin is engaged with the recess.

5. The latch assembly of claim 1, wherein each activation plate includes a slot at one end thereof, an opposite end of each activation plate having a toothed surface, the two toothed surfaces being located to face each other, and the driving device including two pinions engaged with the two toothed surfaces.

6. The latch assembly of claim 5, wherein the teeth of the rotation gears are engaged with notches defined by the second activation plate.

7. The latch assembly of claim 6, wherein the rotation gears are disposed between the second activation plate and the rear plate, and the rotation gears are opposite the second activation plate from the first activation plate and the pinions.

8. The latch assembly of claim 4, wherein the link assembly includes a pivotable link pivotably connected to the side plate of the box, and a first link and a second link are pivotably connected to opposite ends of the pivotable link, the first link including a slot through which the engaging pin extends, and the second link pivotably connected to one of the two rotation gears.

* * * * *